United States Patent [19]

Hamano et al.

[11] Patent Number: 4,622,930

[45] Date of Patent: Nov. 18, 1986

[54] ENGINE STARTER PROTECTING DEVICE

[75] Inventors: Isao Hamano; Akira Morishita; Yoshifumi Akae; Youji Nishimura; Toshinori Tanaka; Kiyoshi Yabunaka, all of Hyogo, Japan

[73] Assignee: Mitsubishi Denki Kabushiki Kaisha, Tokyo, Japan

[21] Appl. No.: 747,494

[22] Filed: Jun. 21, 1985

Related U.S. Application Data

[62] Division of Ser. No. 555,928, Nov. 29, 1983, Pat. No. 4,570,583.

[30] Foreign Application Priority Data

Nov. 30, 1982 [JP] Japan ..... 57-182804

[51] Int. Cl.[4] ..... F02N 11/08

[52] U.S. Cl. ..... 123/179 K; 123/179 A; 123/179 B; 290/37 A; 290/38 D

[58] Field of Search ..... 123/179 B, 179 K, 179 A; 290/38 R, 37 A, 38 D

[56] References Cited

U.S. PATENT DOCUMENTS

| | | | |
|---|---|---|---|
| 2,067,084 | 1/1937 | Hartzell | 290/38 R |
| 2,803,236 | 8/1957 | Tamburello | 123/179 K |
| 3,053,243 | 9/1962 | Domann | 123/179 B |
| 3,712,283 | 1/1973 | Kiess et al. | 123/179 A |
| 3,718,128 | 2/1973 | Botker | 123/179 K |
| 3,872,316 | 3/1975 | Kurii et al. | 123/179 B |
| 4,295,540 | 10/1981 | Hildebrecht | 123/179 K |
| 4,402,286 | 9/1983 | Pagel et al. | 123/179 B |

*Primary Examiner*—Andrew M. Dolinar
*Attorney, Agent, or Firm*—Sughrue, Mion, Zinn,. Macpeak and Seas

[57] ABSTRACT

An engine starter protecting device which prevents engagement of the starter's pinion with the ring gear of the engine, even when the engine is rotating. Sensors detect when the gear shift lever is in the neutral position, when the frequency of the ignition pulses for the engine is above a predetermined value, when the vacuum pressure of the intake air to the engine is at or below a predetermined value, when the vacuum pressure of the intake air to the engine is at or below a predetermined value, and when the output voltage from the altenator of the invention exceeds a predetermined voltage. The electromagnetic switch which controls the starter motor is prevented from operating unless the outputs from the detectors are in predetermined states.

3 Claims, 4 Drawing Figures

ENGINE STARTER PROTECTING DEVICE

This is a Division of application Ser. No. 555,928, filed Nov. 29, 1983, now U.S. Pat. No. 4,570,583.

BACKGROUND OF THE INVENTION

The present invention relates to an engine starter protecting device.

FIG. 1 is an explanatory diagram showing a conventional engine starter arrangement. In FIG. 1, reference numeral 1 designates a starter motor; 2, the rotary shaft of the starter motor 1; 3 and 4, stops fixedly mounted on the rotary shaft 2; 5, an engaging groove member; 6, an over-running clutch composed of an input rotary member 6a and an output rotary member 6b; 7, a pinion; and 8, an engire ring gear engaged with the pinion 7. Further in FIG. 1, reference numeral 10 designates an electromagnetic switch; 11, the plunger of the electromagnetic switch 10; 12, a spring adapted to push the plunger 11 outwardly (to the right in FIG. 1); and 13, a shift lever which turns about a rotating fulcrum 14. The shift lever 13 has an end portion (the lower end portion in FIG. 1) slidably engaged with the engaging groove member 5 so that the engaging groove member 5, the over-running clutch 6 and the pinion 7 are displaced between the stops 3 and 4 by the shift lever 13. When the electromagnetic switch 10 is not electrically energized, the end portion of the shift lever 13 is pushed towards the stop 3 by the elastic force of the spring 12.

The engaging groove member 5, the input rotary member **6*a*, the output rotary member 6*b* and the pinion 7 are fixedly secured to one another, and the inner wall of the input rotary member 6*a* is engaged with a helical spline gear (not shown) formed on the rotary shaft 2. The overdrive clutch 6 is so designed that the drive force of the starter motor 1 is transmitted from the input rotary member 6*a* to the output rotary member 6*b*; however, no power is transmitted in the opposite direction. That is, the clutch 6** is a one-way clutch.

FIG. 2 is a circuit diagram showing a conventional engine starter protecting device. In FIG. 2, reference numerals 1, 10 and 11 designate the starter motor, the electromagnetic switch and the plunger, respectively, which have been described with reference to FIG. 1; 17 and 18, a current coil (attracting coil) and a voltage coil (holding coil), respectively, which operate the plunger 11 when electrically energized; 19, a movable contact secured to the pluger 11; and 20 and 21, stationary contacts of the switch 10. When the switch 10 is not electrically energized, the switch 10 is maintained open by the spring 12 shown in FIG. 1. Further in FIG. 2, reference numeral 22 designates an auxiliary relay for electrically energizing the electromagnetic switch 10; 23, a keyswitch for starting the engine; 24, a battery; and 25, a protecting relay which is operated by the output of an alternator and includes a coil **25*a* and a normally-closed contact 25*b*. The protecting relay 25 is so designated that, when the output voltage of the alternator applied to the terminal L reaches a predetermined value, the normally closed contact 25*b* is opened by the magnetic force produced by the current in the coil 25*a***.

The operation of the conventional engine starter protecting device thus constructed will now be described.

When the keyswitch 23 is closed, the auxiliary relay 22 is energized since the normally closed contact **25*b* is closed when the engine is stopped. Accordingly, the contact of the auxiliary relay 22 is closed so that the current coil 17 and the voltage coil 18 of the electromagnetic switch 18 are electrically energized. As a result, the plunger 11 is operated and the shift lever 13 is turned counterclockwise (in FIG. 1) about the rotating fulcrum 14. Accordingly, the engaging groove member 5, the over-running clutch 6, and the pinion 7 are displaced rightwardly in FIG. 1 against the spring 12 until the pinion 7 engages with the ring gear 8. In this operation, the movable contact 19 of the electromagnetic switch 10 is engaged with the stationary contacts 20 and 21 so that the voltage of the battery 24 is applied to the starter motor 1 and the rotary shaft 2 is rotated. Therefore, the ring gear 8 is rotated through the over-running clutch 6 and the pinion 7. when the pinion 7 is not sufficiently engaged with the ring gear 8, the electromagnetic switch is not closed; however, as a limited current (auxiliary current) flows through the current coil 17 to the starter motor 1, the latter is rotated at a low speed. This causes the pinion 7 to normally engage with the ring gear 8**.

When the output voltage of the alternator reaches the predetermined value after the start of the engine, the normally closed contact **25*b* of the protecting relay 25 is opened. As a result, the electromagnetic switch 10 is deenergized so that the plunger 11 is returned and the pinion 7 disengaged from the ring gear 8**.

The conventional device described above suffers from the following drawback: If the engine stops during ordinary vehicle operation, the protecting relay 25 will not operate if the engine is rotating at a low speed due to an inertial force. Therefore, if the operator closes the keyswitch 23 quickly to make the starter motor 1 operate, the pinion 7 interferes with the ring gear 8 rotating at low speed, as a result of which the pinion 7 and the ring gear 8 will not satisfactorily engage with each other and may be damaged.

In view of the foregoing, an object of this invention is to provide an engine starter protecting device which, even when the engine is rotating at low speed, engagement of the starter's pinion with the engine's ring gear is prevented.

SUMMARY OF THE INVENTION

Achieving the above-described object, in an engine starter protecting device according to the invention a plurality of outputs related to the rotation of the engine and the gear shift position are detected to limit the engine starting conditions so that the engine can be started only when the outputs are not in active states and the engine is disconnected from the wheels.

DESCRIPTION OF THE PREFERRED EMBODIMENTS

Figure 1:
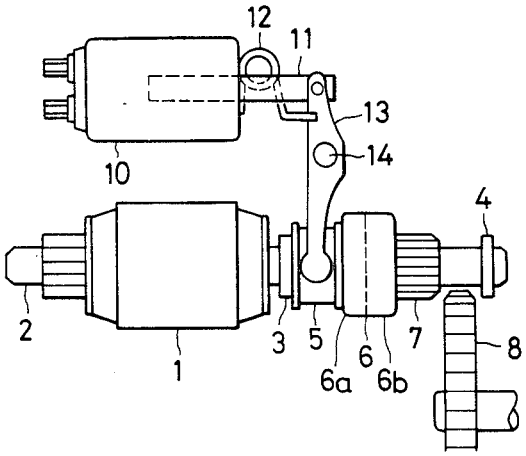
FIG. 1 PRIOR ART
FIG. 1 is an explanatory diagram showing the arrangement of a conventional engine starter.
Figure 2:
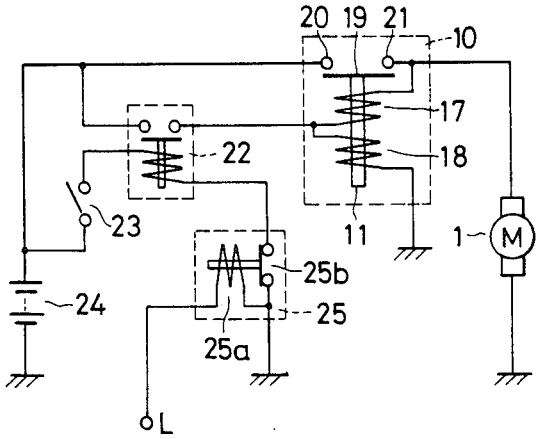
FIG. 2 PRIOR ART
FIG. 2 is a circuit diagram showing a conventional engine starter protecting device.
Figure 3:
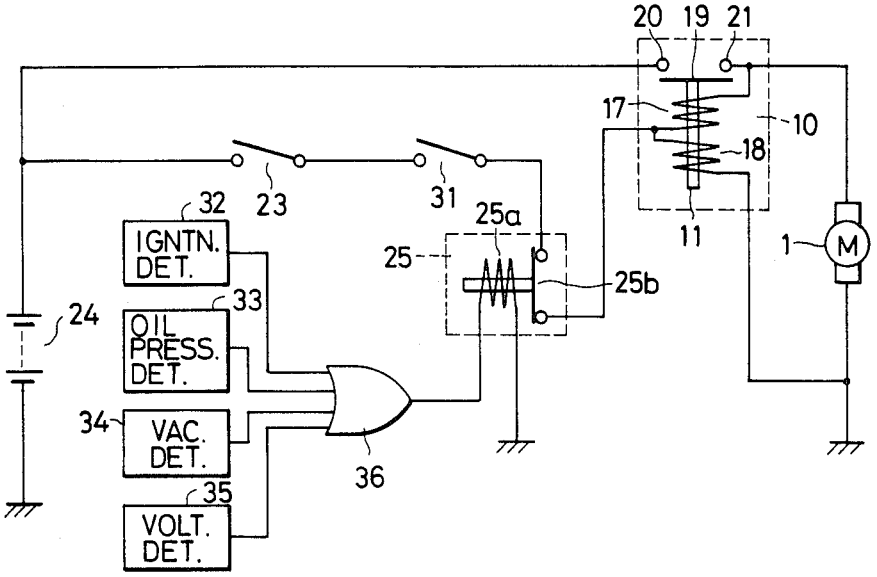
FIG. 3 is a circuit diagram showing a first embodiment of an engine starter protecting device of the invention.

FIG. 3 is a circuit diagram showing a first preferred embodiment of an engine starter protecting device according to the invention. In FIG. 3, those components which have been previously described with reference to FIGS. 1 and 2 are designated by the same reference numerals for simplification of description.

In FIG. 3, reference numeral 31 designates a first switch, namely, a neutral switch which is closed when the gear shift lever is at the neutral position. Further in FIG. 3, reference numeral 32 designates an ignition detector which provides an "H" (high level) output when the frequency of engine ignition pulses is a predetermined value or higher; 33, an oil pressure detector which provides an "H" output when the engine oil pressure is a predetermined value or higher; 34, a vacuum detector which provides an "H" output when the vacuum pressure in the intake manifold of the engine is below a predetermined value; 35, a charging (voltage) detector which provides an "H" output when the output voltage of the alternator is a predetermined value or higher; and 36, an OR gate which, when at least one of the output signals provided by these detectors is at the "H" level, energizes the coils 25*a* of the protecting relay 25, thereby to open the normally closed contact 25*b*. The detectors 32 through 35 and the OR gate 36 form a second switch.

The operation of the circuit thus constructed will now be described.

When the engine is stopped, that is, when the outputs of the ignition detector 32, the oil pressure detector 33, the vacuum detector 34 and the charge detector 35 are at "L", the output of the OR gate 36 is also at "L", and thereore the normally closed contact 25*b* of the protecting relay 25 is closed. When, under this engine stopped condition, the gear shift lever is set at the neutral position to close the neutral switch 31 and the keyswitch 23 is closed, the starter motor 1 can be energized to start the engine. On the other hand, when any one of the output signals of the detectors is applied to the OR gate 36 after the start of the engine, the protecting relay 25 is operted to open the normally closed contact 25*b*, and accordingly the contact of the electromagnetic switch 10 is also opened. As a result, the starter motor 1 cannot be activated, and the shift lever 13 is returned to disengage the pinion 7 from the ring gear 8.

As is apparent from the above description, by the operation of any one of the detectors, the starter motor 1 is automatically stopped after the engine has been stated. The starter motor 1 can be energized again only after the engine has been completely stopped. If the engine stops during normal operation, the starter motor 1 cannot be energized because the gear shift lever is not at the neutral position, and accordingly the neutral switch 31 is maintained open even if the keyswitch 23 is operated. On the other hand, even when the gear shift lever is set at the neutral position and the keyswitch 23 closed, in order to energize the starter motor 1, all the inputs to the OR gate 36 must be at the "L" level with the engine completely stopped. This prevents the problem of the pinion 7 engaging with the ring gear 8 while the latter is rotating.

Figure 4:
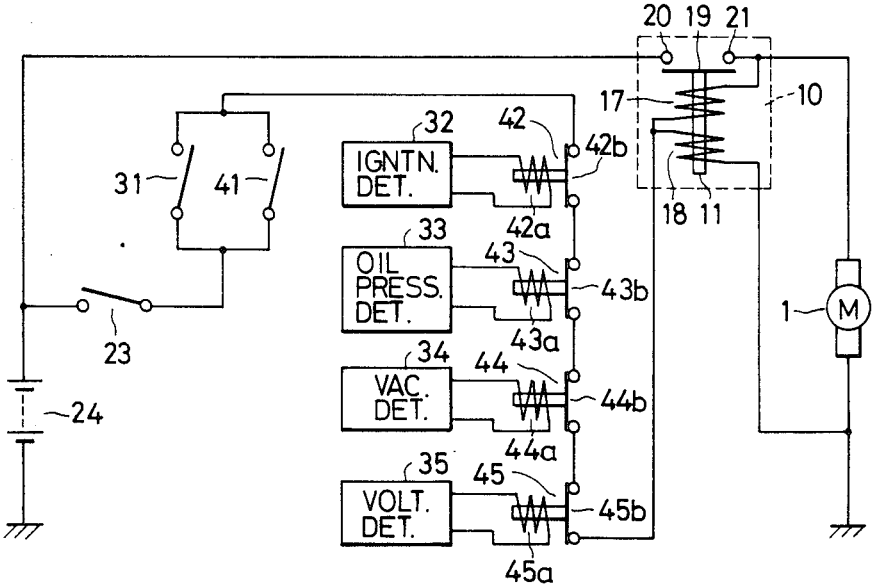
FIG. 4 is a circuit diagram showing a second embodiment of an engine starter protecting device according to the invention.

FIG. 4 is a circuit diagram showing a second embodiment of an engine starter protecting device of the invention. In FIG. 4, those components which have been previously described with reference to FIG. 3 are designated by the same reference numerals for simplification of description.

In FIG. 4, reference numeral 41 designates a clutch switch which is closed when the clutch pedal is depressed, the clutch switch 41 together with the neutral switch 31 forming a first switch; 42, a relay in which, when the output of the ignition detector 32 is at "H", a coil 42*a* is electrically energized to open a normally closed contact 42*b*; 43, a relay in which, when the output of the oil pressure detector 33 is at "H", a coil 43*a* is electrically energized to open a normally closed contact 43*b*; 44, a relay in which, when the output of the vaccum detector 34 is at "H", a coil 44*a* is electrically energized to open a normally closed contact 44*b*; and 45, a relay in which, when the output of the charging detector 35 is at "H", a coil 45*a* is electrically energized to open a normally closed contact 45*b*. These detectors and relays form a second switch.

In the second embodiment of FIG. 4, if the gear shift lever is not at the neutral position, the neutral switch 31 is not closed. However, the clutch switch 41 is closed when the clutch pedal is depressed. If, in this case, the engine has been completely stopped and the contacts of all the relays 42 through 45 have been closed, the engine can be started by closing the keyswitch 23.

As is clear from the above description, according to the invention, at least one of the neutral switch and clutch switch and the relays operated by the detectors for detecting the rotation of the engine are connected in series with the keyswitch. Therefore, only when the engine is disconnected from the wheels and is stopped can the starter be operated. Accordingly, the starting operation is considerably improved in reliability. Furthermore, the problem that the starter's pinion and the engine's ring gear are not satisfactorily engaged with each other and can be damaged is prevented with the use of the invention.

We claim:

1. An engine starter protecting device for an engine starter of a type comprising a starter motor (1) for turning an engine, an electromagnetic switch (10) for controlling said starter motor, a key switch (23) for controlling said electromagnetic switch, and a battery (24) for electrically energizing said starter motor and said electromagnetic switch, comprising:

a first switch (31), operatively associated with said engine, which is closed when said engine is disengaged from wheels and otherwise opened, and second switch means operatively associated with said engine, which is opened when a speed of rotation of said engine is at or above a predetermined value and otherwise closed, said first switch and second switch means being connected in series with one another and coupled between said battery and said electromagnetic switch for controlling actuation of said electromagnetic switch;

wherein said second switch means comprises at least two detectors selected from a group consisting of an ignition detector (32) which operates when the frequency of engine ignition pulses is at a predetermined value or higher, an oil pressure detector (33) which operates when an engine lubrication oil pressure is at a predetermined value or higher, a vacuum pressure detector (34) which operates when a pressure of intake air to said engine is at a predetermined value or lower, and a charging detector (35) which operates when an output voltage of an alternator is at a predetermined value or higher; a plurality of relay coils (42*a*–45*a*) individually coupled to outputs of said detectors, each of said coils being energized when its associated detector operates, and a plurality of normally closed relay switches (42*b*–45*b*) connected in series and individually associated with and opened by said relay coils when energized.

2. The engine starter protecting device as claimed in claim 1, wherein said first switch is a clutch switch closed when a clutch is depressed.

3. The engine starter protecting device as claimed in claim 1, wherein said first switch comprises a neutral switch closed when a gear shift lever is at a neutral position, and a clutch switch closed when a clutch is depressed, said neutral switch being connected in parallel with said clutch switch.

* * * * *